US010435201B2

(12) United States Patent
Hopps et al.

(10) Patent No.: US 10,435,201 B2
(45) Date of Patent: Oct. 8, 2019

(54) PACKAGING ASSEMBLY

(71) Applicant: JT International S.A., Geneva (CH)

(72) Inventors: Jason Hopps, Coleraine (GB); Kevin Joseph Maguire, Dublin (IE); Christopher William Murphy, Dublin (IE); Lyndsey Alice Bryce, Dublin (IE)

(73) Assignee: JT International S.A. (CH)

( * ) Notice: Subject to any disclaimer, the term of this patent is extended or adjusted under 35 U.S.C. 154(b) by 329 days.

(21) Appl. No.: 15/307,278

(22) PCT Filed: Apr. 23, 2015

(86) PCT No.: PCT/EP2015/058822

§ 371 (c)(1),
(2) Date: Oct. 27, 2016

(87) PCT Pub. No.: WO2015/165801

PCT Pub. Date: Nov. 5, 2015

(65) Prior Publication Data

US 2017/0043910 A1 Feb. 16, 2017

(30) Foreign Application Priority Data

Apr. 29, 2014 (EP) ..... 14166417

(51) Int. Cl.
*B65D 25/38* (2006.01)
*B65D 43/20* (2006.01)
(Continued)

(52) U.S. Cl.
CPC ..... *B65D 25/38* (2013.01); *A24F 15/12* (2013.01); *A24F 47/008* (2013.01); *A45C 11/24* (2013.01);
(Continued)

(58) Field of Classification Search
CPC .... B65D 25/38; B65D 25/108; B65D 43/165; B65D 43/163; B65D 43/26; B65D 43/20;
(Continued)

(56) References Cited

U.S. PATENT DOCUMENTS 1,934,138 A * 11/1933 Paul ..... B65D 25/38
206/247
2,155,613 A * 4/1939 Negbaur ..... A24F 15/12
206/1.5
(Continued)

FOREIGN PATENT DOCUMENTS

JP 50-112480 U 9/1975
JP 51-146149 U 11/1976
(Continued)

OTHER PUBLICATIONS

International Search Report and Written Opinion for Application No. PCT/EP15/58822, dated Aug. 4, 2015 (8 pages).
(Continued)

*Primary Examiner* — Jeffrey R Allen
*Assistant Examiner* — Jennifer Castriotta
(74) *Attorney, Agent, or Firm* — Lerner, David, Littenberg, Krumholz & Mentlik, LLP

(57) ABSTRACT

The present invention provides a packaging assembly for packaging one or more articles, comprising: an inner body part which defines at least one inner compartment to receive an article; an outer body part that at least partially encompasses the inner body part; and a cover member which is movable between a closed position to prevent access to the at least one inner compartment and an open position to permit access to the at least one inner compartment; wherein the outer body part is movable relative to the inner body part
(Continued)

Figure 1:
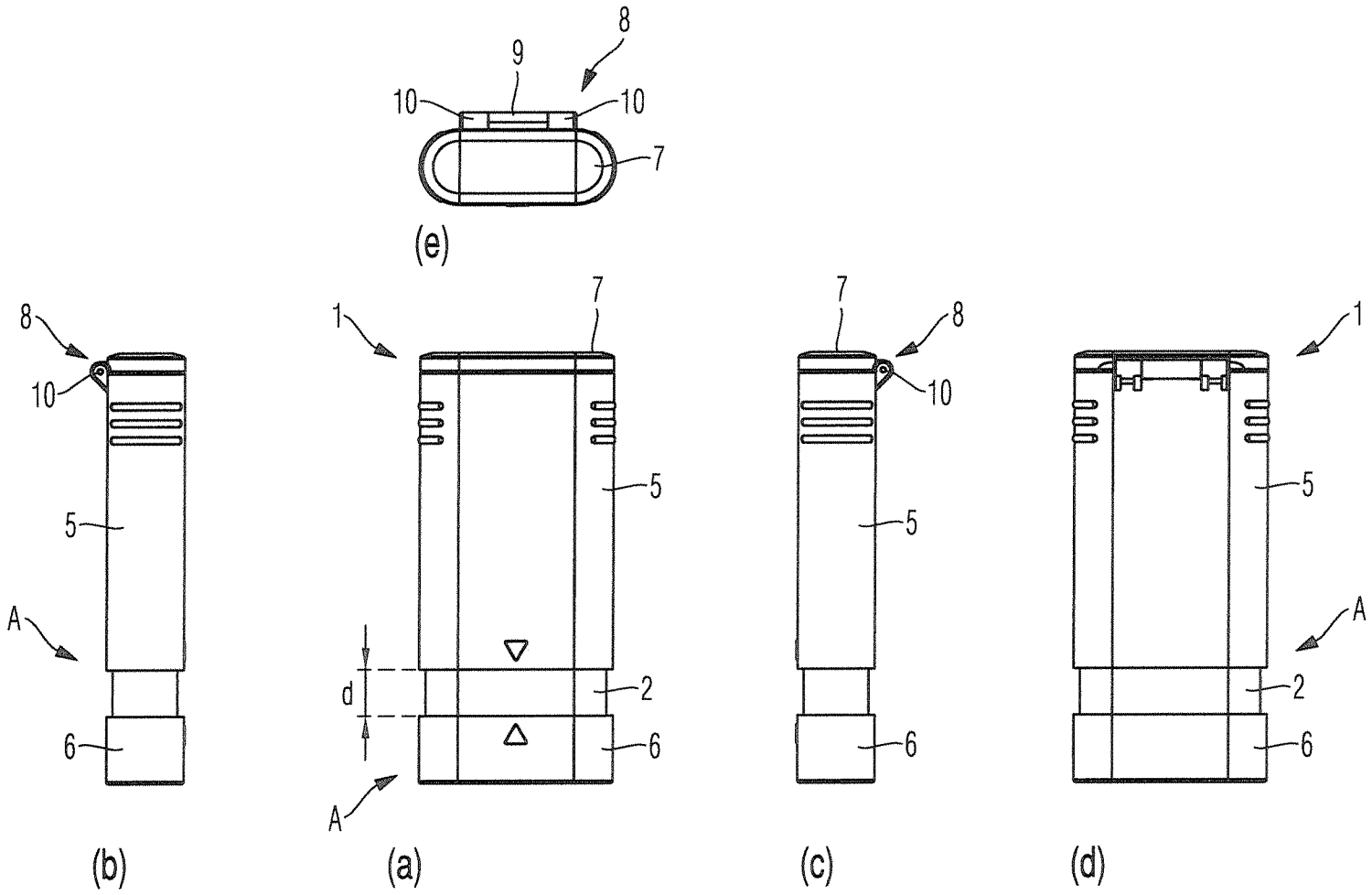

between a first position and a second position to move the cover member between the closed position and the open position.

16 Claims, 9 Drawing Sheets

(51) Int. Cl.

| | |
|---|---|
| ***B65D 43/26*** | (2006.01) |
| ***B65D 43/16*** | (2006.01) |
| ***B65D 43/24*** | (2006.01) |
| ***A45C 11/24*** | (2006.01) |
| ***A45C 13/00*** | (2006.01) |
| ***A24F 15/12*** | (2006.01) |
| ***A45D 40/02*** | (2006.01) |
| ***A24F 47/00*** | (2006.01) |
| ***B65D 25/10*** | (2006.01) |
| ***B65D 25/34*** | (2006.01) |
| ***B65D 85/20*** | (2006.01) |

(52) U.S. Cl.
CPC ..... *A45C 13/00* (2013.01); *A45C 13/005* (2013.01); *A45C 13/007* (2013.01); *A45D 40/023* (2013.01); *B65D 25/108* (2013.01); *B65D 25/34* (2013.01); *B65D 43/165* (2013.01); *B65D 43/166* (2013.01); *B65D 43/20* (2013.01); *B65D 43/24* (2013.01); *B65D 43/26* (2013.01); *B65D 85/20* (2013.01)

(58) Field of Classification Search
CPC ..... B65D 43/22; B65D 21/086; B65D 85/20; A24F 15/14; A24F 15/12; A24F 9/16; A24F 47/008; A45C 11/24
See application file for complete search history.

(56) References Cited

U.S. PATENT DOCUMENTS

| | | | | |
|---|---|---|---|---|
| 4,666,036 | A * | 5/1987 | Bourbon | A45C 11/24 206/425 |
| 4,687,099 | A * | 8/1987 | Van Buuren | A45D 40/24 132/286 |
| 5,732,820 | A * | 3/1998 | Tsai | B65D 43/20 206/369 |
| 2005/0286014 | A1 | 12/2005 | Chao | |
| 2007/0108076 | A1* | 5/2007 | Miller | B25H 3/003 206/373 |
| 2008/0179323 | A1 | 7/2008 | Circosta et al. | |
| 2014/0299623 | A1* | 10/2014 | Giraud | B65D 83/0864 221/279 |

FOREIGN PATENT DOCUMENTS

| | | | |
|---|---|---|---|
| JP | 52-140985 | U | 10/1977 |
| JP | 02-122620 | U | 10/1990 |
| WO | 2008/091441 | A1 | 7/2008 |
| WO | 2013/142671 | A1 | 9/2013 |

OTHER PUBLICATIONS

Japanese Office Action for Application No. 2016-565253, dated Sep. 1, 2017 (15 Pages).

* cited by examiner (h)

(i)

(k)

(b)

PACKAGING ASSEMBLY

Priority is claimed under 35 U.S.C. § 119 to European Application No. 14166417.7 filed on Apr. 29, 2014 and under 35 U.S.C. § 365 to PCT/EP2015/058822 filed on Apr. 23, 2015.

The invention concerns a packaging assembly for articles to be packaged, as well as to a pack of such articles.

The packaging assembly of the invention is especially suited to the packaging of inhaler devices, such as electronic vapor delivery systems, electronic cigarettes, or "e-cigarettes" as they are also known. Thus, the invention particularly also provides a pack of those articles. Importantly, however, it will be noted that the packaging assembly of the invention is not limited to this specific packaging application, but may be suited to, and employed for, a range of other articles.

Inhaler devices of the above types, like personal vaporizers, e-cigarettes and electronic vapor delivery systems, have been proposed as alternatives to traditional smoking articles, such as cigarettes, cigarillos, cigars and the like. Although these inhaler devices are still relatively new in the market-place, some efforts have already been made to develop new and convenient packaging concepts for them. One example of such a packaging concept is described in WO 2013/142671 A1.

The present invention is directed to the task of providing a new, convenient, and user-friendly packaging concept which is especially suited to inhaler devices, such as e-cigarettes or personal vaporizers.

In accordance with the invention, a packaging assembly having the features as recited in claim 1 is provided. A number of preferred and/or advantageous features of the invention are recited in the dependent claims.

According to one aspect, therefore, the invention provides a packaging assembly for packaging one or more articles, which comprises:

- an inner body part which defines at least one inner compartment to receive an article;
- an outer body part which at least partially encompasses the inner body part; and
- a cover member movable between a closed position which prevents access to the at least one inner compartment, and an open position which permits access to the at least one inner compartment;
- wherein the outer body part is movable relative to the inner body part between a first position and a second position to move the cover member between the closed position and the open position.

In this way, the invention provides a packaging assembly with a simple and convenient mechanism for opening and closing the cover member to permit or prevent access to the one or more articles contained in the inner compartment(s). Thus, when a user handles the packaging assembly, it is not necessary for the user to additionally handle the cover member directly in order to access its contents. Rather, by merely handling the outer body part of the packaging assembly the user is able to open the cover member by manually moving the outer body part relative to the inner body part.

In a particularly preferred embodiment, the outer body part of the packaging assembly is configured to be grasped and/or held by a user. To this end, the outer body part may include a gripping portion, e.g. having one or more grip elements, to promote a comfortable and secure handling of the outer body part by a user. The gripping portion, e.g. with one or more grip elements, may thus facilitate easier manual movement of the outer body part relative to the inner body part. To this end, the gripping portion including any grip element(s) may, for example, have a contoured surface profile and/or may comprise a relatively soft or resilient synthetic material to enhance a user's grip on the outer body part.

In a preferred embodiment, the inner body part is configured to accommodate one or more elongate articles in the at least one inner compartment. In this regard, each inner compartment is preferably configured to receive and hold one or more e-cigarette. Further, the inner body part may be configured and arranged in the packaging assembly, e.g. with respect to the outer body part, such that a proffering or a presentation of the articles is performed or achieved by the opening of the cover member when the outer body part is moved to the second position relative to the inner body part. In this way, the packaging assembly not only provides a simple and convenient mechanism for opening and closing a pack of articles, but may also be configured to proffer or to present those articles to a user when the packaging is opened.

In a preferred embodiment, the packaging assembly includes a retainer means for inhibiting or preventing the one or more elongate articles in the at least one inner compartment from inadvertently falling out of the inner body part when the cover member is in the open position. In this regard, the retainer means is desirably arranged in the inner compartment and is preferably configured to contact the article(s) and to impart a resistance, e.g. a frictional resistance, to removal of an article therefrom. Advantageously, the retainer means may include fibers or hairs provided in the inner compartment for contacting and providing a frictional resistance to the movement of an article. Alternatively, or in addition, the retainer means may include jaw members which hold the article against inadvertent removal.

In a preferred embodiment, the packaging assembly includes a sealing element configured to form a substantially airtight closure or seal of an opening in the outer body part and/or of the inner compartment in the inner body part in the closed position. The sealing element may be formed or provided on an inner face of the cover member. The cover member may itself be provided in the form of a lid or cap, for example, at an upper end region of the packaging assembly. Thus, the sealing element may be arranged at or around an edge or rim of the lid or cap for sealing against the outer body part and/or inner body part, when that lid or cap is in the closed position. Alternatively, the sealing element may be provided (e.g. as a sealing gasket) on an upper rim or edge of the outer body part and/or the inner body part.

In a preferred embodiment, the cover member is connected to the outer body part and is configured to move from the closed position to the open position when the outer body part is respectively moved relative to the inner body part from the first position to the second position. More particularly, the cover member is preferably pivotally connected to the outer body part, e.g. via a hinge connection, for pivoting movement between the closed position and the open position when the outer body part moves relative to the inner body part between the first position and second position, respectively. In this regard, the cover member is pivotally connected to the outer body part via an outer pivot axis.

In a particularly preferred embodiment of the invention, the cover member is pivotally connected to the inner body part, e.g. via a hinge connection, so that the cover member pivots between the closed and open positions relative to the inner body part. The cover member is thereby pivotally connected to the inner body part via an inner pivot axis. The cover member may thus be pivotally connected to both the inner body part and the outer body part. In that event, the inner pivot axis is typically substantially parallel to, but laterally and/or inwardly offset from, the outer pivot axis. Also, one of the inner and outer pivot axes is preferably displaceable relative to the respective inner or outer body part.

In a preferred embodiment, the outer body part is configured for translational or sliding movement relative to the inner body part between the first position and the second position. In this way, a user may grasp the outer body part and slide or displace (e.g. translate) that outer body part relative to the inner body part for movement between the first and second positions. In a preferred embodiment, the outer body part forms an upper portion of the packaging and the inner body part forms a lower or base portion of the packaging, whereby a translational relative movement may be effected by applying downward pressure to the outer body part. Alternatively, or in addition, the outer body part may be configured for rotary or rotational movement relative to the inner body part between the first position and the second position.

In a preferred embodiment, the inner body part forms an inner casing defining the at least one inner compartment to receive an article and the outer body part forms an outer casing that at least partially surrounds or encloses the inner casing, e.g. in the manner of a sleeve. The outer casing may thus be configured to be moved, i.e. to translate and/or to rotate, relative to the inner casing which receives and contains the article(s). In a particularly preferred embodiment, the inner body part and the outer body together form a container of the packaging assembly, with the cover member being movable to open and close the container.

In a preferred embodiment, the packaging assembly may further include a biasing means, such as at least one spring member, which is configured and arranged to bias or to urge the outer body part towards the first position relative to the inner body part. Thus, the movement of the outer body part relative to the inner body part from the first position to the second position is performed against this bias or force (e.g. spring bias). In other words, the packaging assembly acts or tends to return the outer body part to the first position.

In a particularly preferred embodiment, either or both of the inner body part and the outer body part include(s) stop means which are configured to define the first and second positions and which serve to stop or limit movement of the outer body part relative to the inner body part between those first and second positions. Each stop means typically comprises one or more abutment member, such as a projection or shoulder, which interact or inter-engage to prevent further relative movement at the first and second positions.

In a preferred embodiment, the inner and outer body parts include complementary latching means which are configured and arranged to engage and releasably interlock with each other when the outer body part is moved to the second position relative to the inner part, thereby to hold the cover member in the open position. In this context, the complementary latching means include at least one first latching element on an inner side or surface of the outer body part and at least one second latching element respectively provided on an outer side or surface of the inner body part. The first and second latching elements of the complementary latching means are configured to engage and releasably interlock with each other when the outer body part is moved to the second position and preferably also to disengage or release from each other when a predetermined pressure or traction force is exerted on the inner body part, e.g. at an end thereof, relative to the outer body part. For example, when the packaging assembly is held in the hand of a user, the insertion of an article into the inner compartment may exert a force on the inner body part that acts to disengage the complementary latching means. In this way, the outer body part may move relative to the inner body part (e.g. under the action of a spring bias) from the second position back to the first position so as to move the cover member from the open position back to the closed position when the article is introduced into the compartment. Even the weight of the articles (e.g. e-cigarettes) acting on the inner body part relative to the outer body part held in a user's hand could be sufficient to disengage or release the complementary latching means. Each article or e-cigarette may have a mass of a few gram, e.g. 4 or 5 g. One or more of the first and second latching elements may be deformable or deflectable to facilitate their interlocking and/or release.

In a particularly preferred embodiment, therefore, the first latching element has a first locking face which cooperates and interlocks with a complementary second locking face of the second latching element when the outer body part is moved to the second position relative to the inner body part, so as to hold the cover member in the open position. To this end, the locking faces of the first and second latching elements typically abut or rest against each other. The first latching element may also have a first inclined face that cooperates with a second inclined face of the second latching element as the outer body part moves relative to the inner body part towards the second position. The first inclined face and the first locking face preferably converge with one another from a common plane, while the second inclined face and the second locking face may also converge with one another from a common plane.

In a particularly preferred embodiment, the inner body part, the outer body part, and the cover member are made from a polymer plastic material, such as polyethylene, polypropylene or polyurethane, and are preferably injection molded.

In another aspect, the invention provides a pack of articles, such as e-cigarettes, having a packaging assembly according to any one of the embodiments described above. That is, the pack of articles includes a packaging assembly comprising:

- an inner body part defining an inner compartment or a plurality of inner compartments containing the said articles;
- an outer body part which at least partially encloses or surrounds the inner body part; and
- a cover member that is movable between a closed position to prevent access to the inner compartment(s), and an open position to permit access to the inner compartment(s);
- wherein the outer body part is movable relative to the inner body part between a first position and a second position to move the cover member between the closed position and the open position, respectively.

Figure 2:
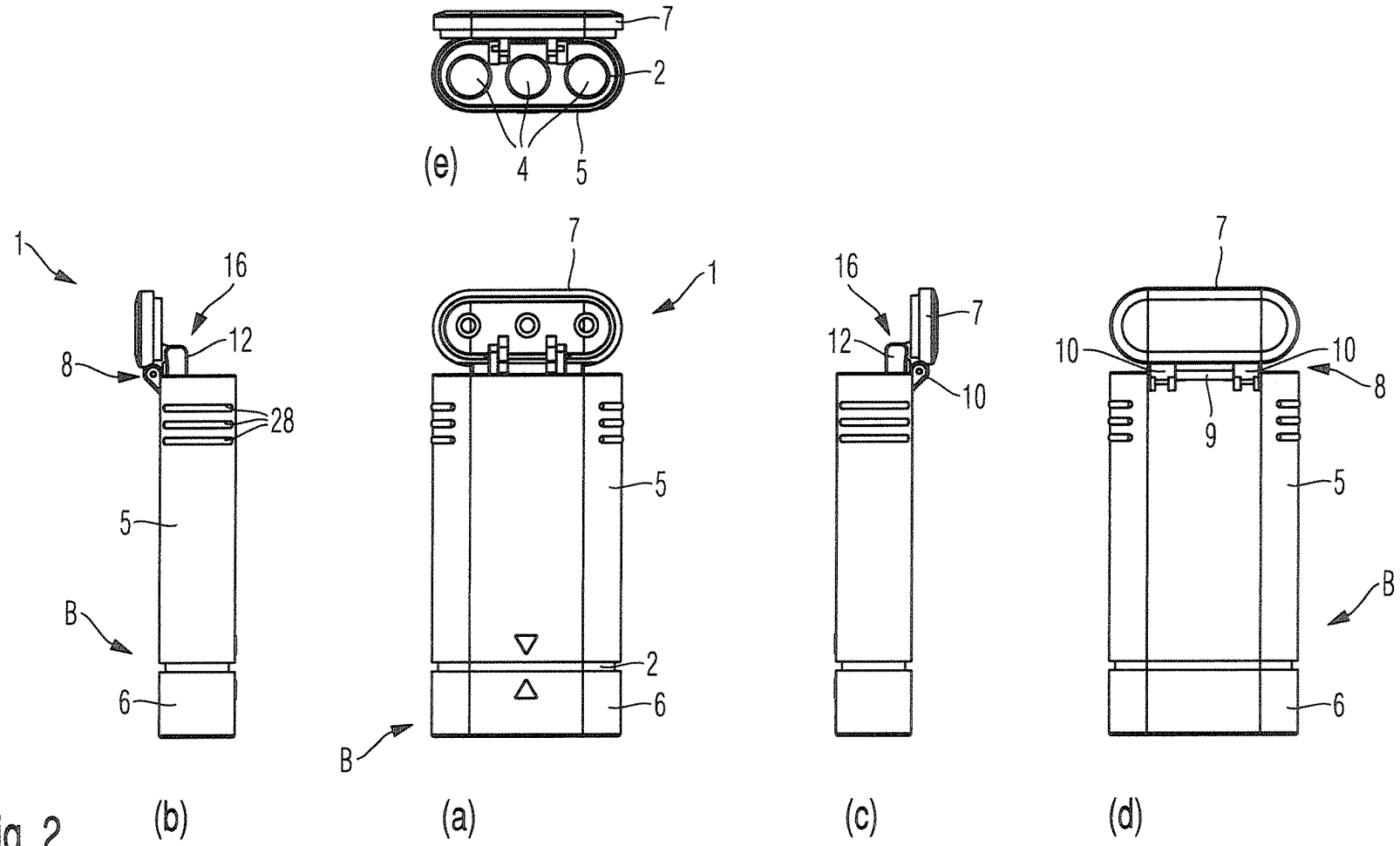
Figure 3:
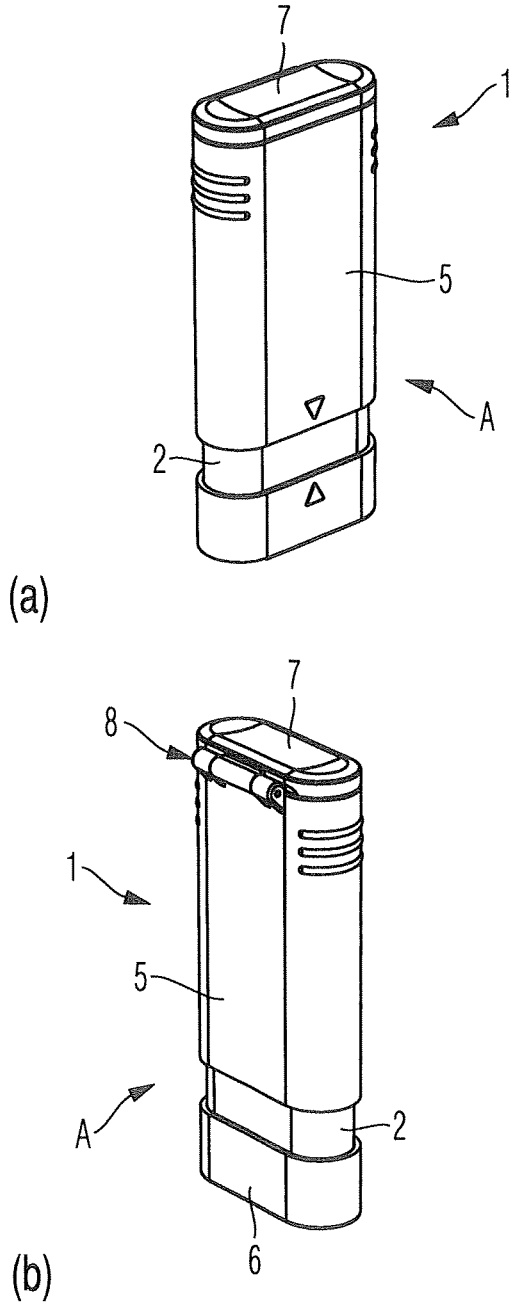
Figure 4:
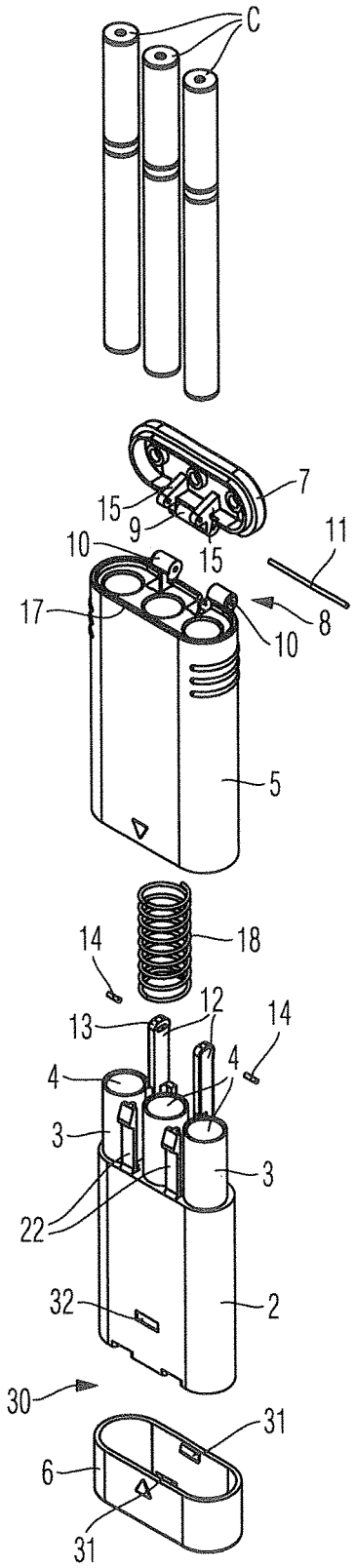
Figure 5:
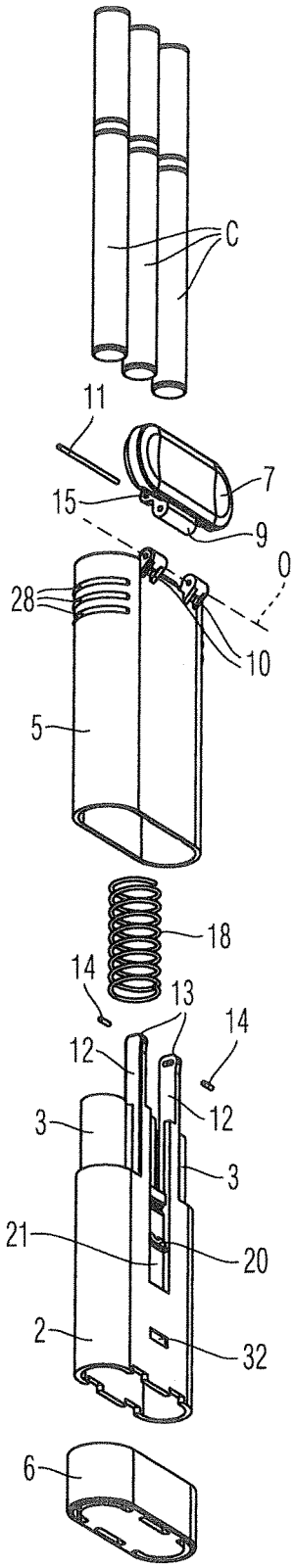
Figure 6:
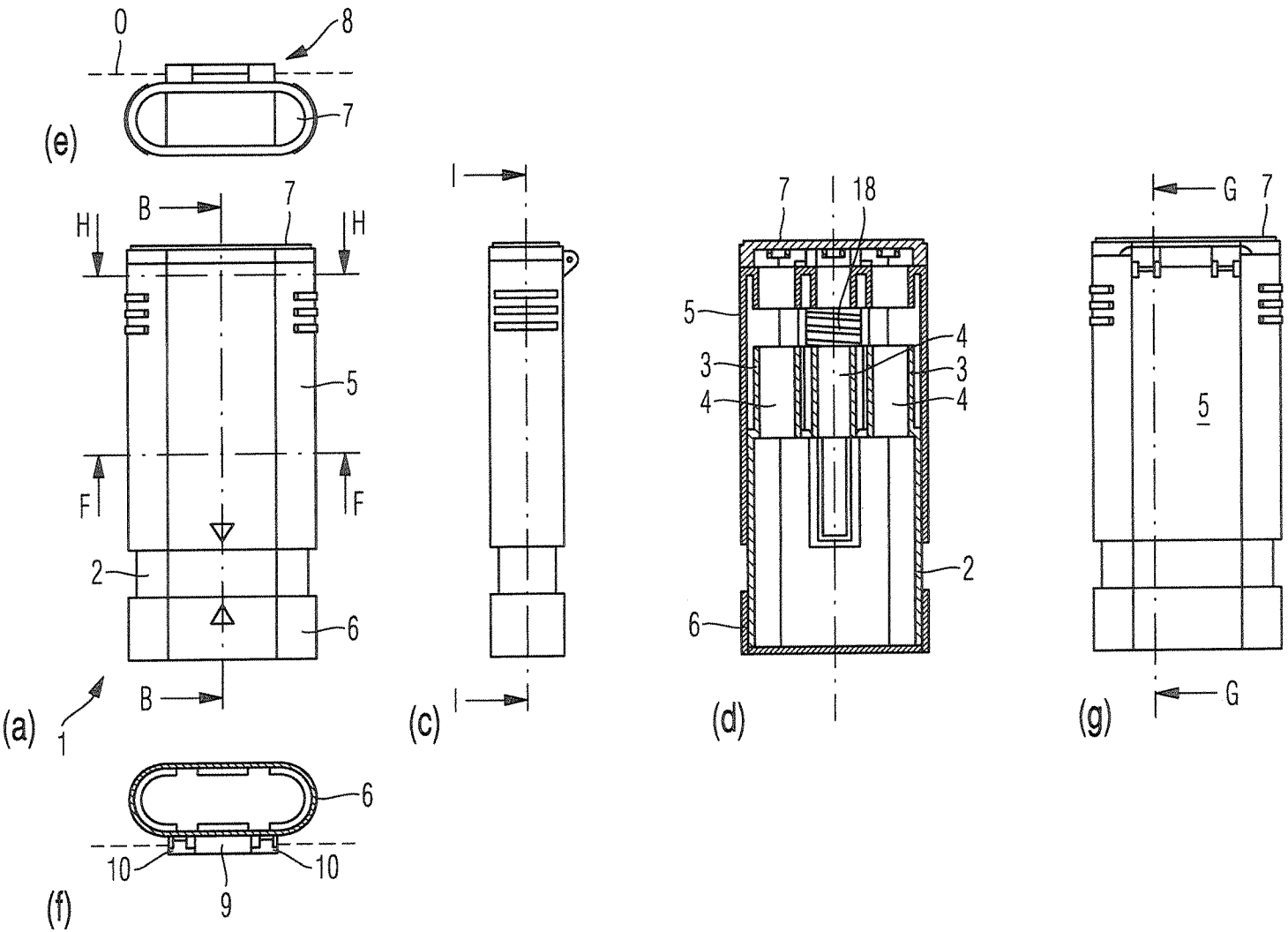
Figure 6:
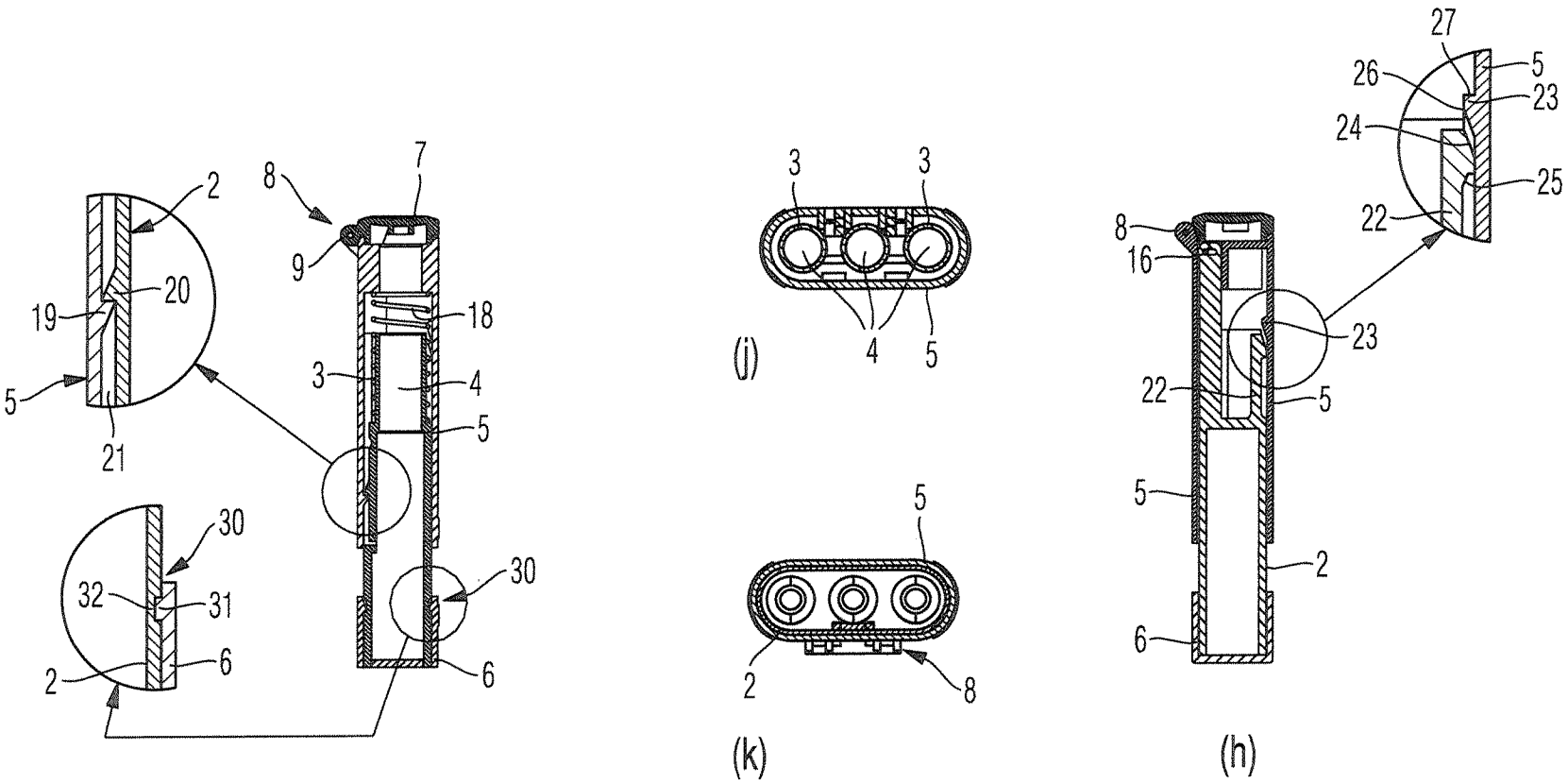
Figure 7:
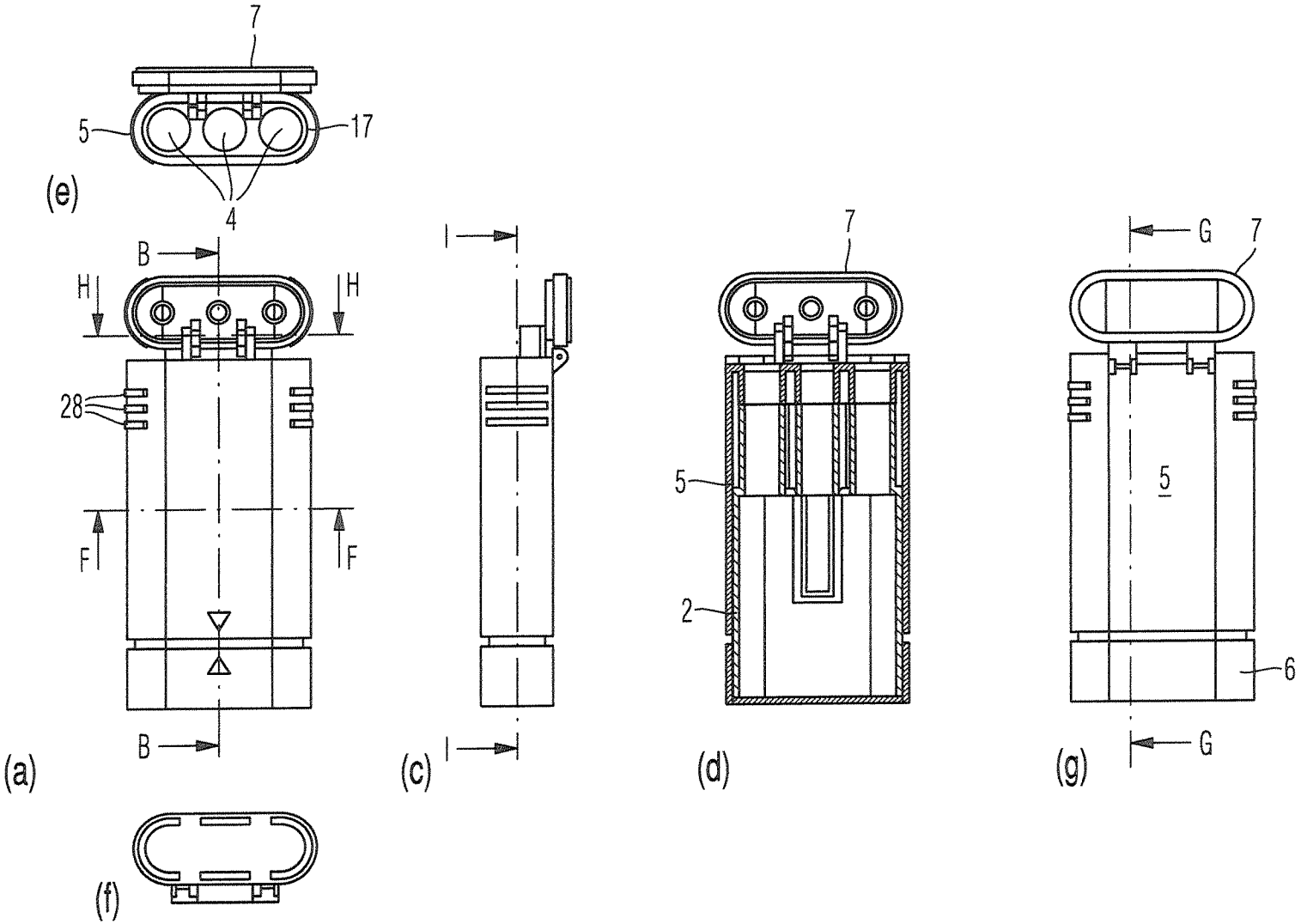
Figure 7:
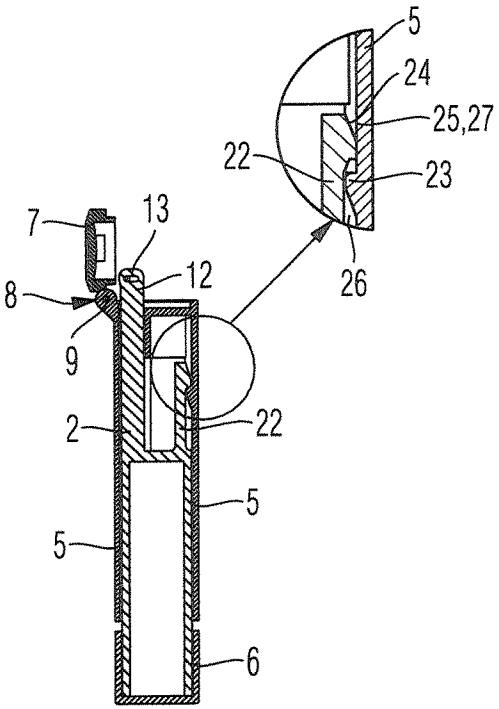
Figure 7:
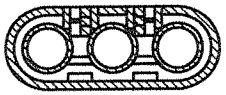
Figure 7:
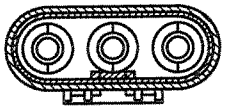
Figure 7:
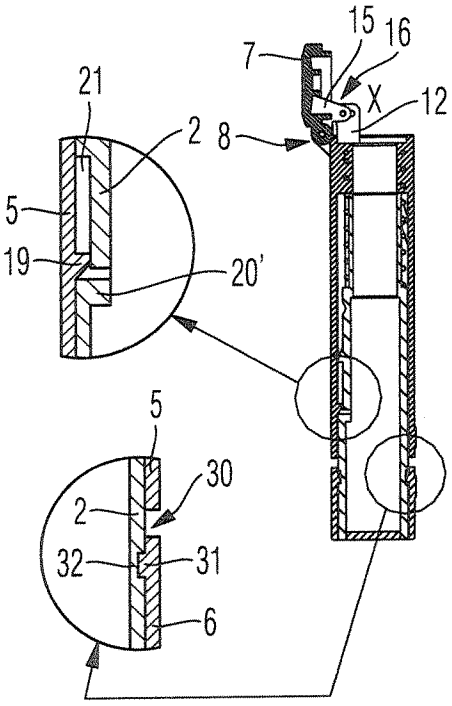

For a more complete understanding of the invention and the advantages thereof, exemplary embodiments of the invention are explained in more detail in the following description with reference to the accompanying drawing figures, in which like reference characters designate like parts and in which are shown:

FIG. 1(*a*) a front view of a packaging assembly according to a particular embodiment of the invention with the lid in a closed position;

FIG. 1(*b*) a side view of the packaging assembly in FIG. 1(*a*);

FIG. 1(*c*) a side view of the packaging assembly in FIG. 1(*a*);

FIG. 1(*d*) a rear view of the packaging assembly in FIG. 1(*a*);

FIG. 1(*e*) a top view of the packaging assembly in FIG. 1(*a*);

FIG. 2(*a*) a front view of the packaging assembly in FIG. 1 with the lid in an open position;

FIG. 2(*b*) a side view of the packaging assembly in FIG. 2(*a*);

FIG. 2(*c*) a side view of the packaging assembly in FIG. 2(*a*);

FIG. 2(*d*) a rear view of the packaging assembly in FIG. 2(*a*);

FIG. 2(*e*) a top view of the packaging assembly in FIG. 2(*a*);

FIG. 3(*a*) a front perspective view of the packaging assembly shown in FIG. 1;

FIG. 3(*b*) a rear perspective view of the packaging assembly shown in FIG. 1;

FIG. 4 a front perspective exploded view of the packaging assembly shown in FIG. 2 with e-cigarettes;

FIG. 5 a rear perspective exploded view of the packaging assembly shown in FIG. 2 with e-cigarettes;

FIG. 6(*a*) a front view of a packaging assembly corresponding to FIG. 1(*a*);

FIG. 6(*b*) a cross-section view in the direction of arrows B-B in FIG. 6(*a*);

FIG. 6(*c*) a side view corresponding to FIG. 1(*c*);

FIG. 6(*d*) a cross-section view in the direction of arrows I-I in FIG. 6(*c*);

FIG. 6(*e*) a top view corresponding to FIG. 1(*e*);

FIG. 6(*f*) a bottom view of the packaging assembly;

FIG. 6(*g*) a rear view corresponding to FIG. 1(*d*);

FIG. 6(*h*) a cross-section view in the direction of arrows G-G in FIG. 6(*g*);

FIG. 6(*j*) a cross-section view in the direction of arrows H-H in FIG. 6(*a*);

FIG. 6(*k*) a cross-section view in the direction of arrows F-F in FIG. 6(*a*);

FIG. 7(*a*) a front view of a packaging assembly corresponding to FIG. 2(*a*);

FIG. 7(*b*) a cross-section view in the direction of arrows B-B in FIG. 7(*a*);

FIG. 7(*c*) a side view corresponding to FIG. 2(*c*);

FIG. 7(*d*) a cross-section view in the direction of arrows I-I in FIG. 7(*c*);

FIG. 7(*e*) a top view corresponding to FIG. 2(*e*);

FIG. 7(*f*) a bottom view of the packaging assembly;

FIG. 7(*g*) a rear view corresponding to FIG. 2(*d*);

FIG. 7(*h*) a cross-section view in the direction of arrows G-G in FIG. 7(*g*);

FIG. 7(*j*) a cross-section view in the direction of arrows H-H in FIG. 7(*a*); and FIG. 7(*k*) a cross-section view in the direction of arrows F-F in FIG. 7(*a*).

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

With reference firstly to FIGS. 1(*a*) to 1(*e*) and FIGS. 2(*a*) to 2(*e*), a packaging assembly 1 according to a particularly preferred embodiment is illustrated in a series of orthogonal views. FIGS. 1(*a*) to 1(*e*) show the packaging assembly 1 in a closed state, whereas FIGS. 2(*a*) to 2(*e*) show the packaging assembly 1 in an open state. That same packaging assembly 1 is then shown in perspective views in FIGS. 3(*a*) and 3(*b*) and in exploded views in FIG. 4 and FIG. 5.

As is particularly apparent from FIGS. 4 and 5, the packaging assembly 1 of this embodiment is specifically designed for elongate cylindrical-shaped articles C, such as e-cigarettes. To this end, the packaging assembly 1 includes an inner body part 2 in the form of an inner casing which includes three aligned tubular receptacles 3, each of which has a respective upper opening and each of which defines an inner compartment 4 for receiving a respective one of the elongate articles C or e-cigarettes. Further, the packaging assembly 1 includes an outer body part 5 in the form of an outer casing which substantially surrounds or encompasses an upper portion of the inner casing 2. In this regard, the outer casing 5 has a geometry that is similar to, but slightly larger than, that of the inner casing 2. Thus, the outer casing 5 is configured to be mounted over an upper region of the inner casing 2 in the manner of a sleeve. That is, the inner casing 2 fits with a small amount of play within a cavity enclosed by the outer casing 5. In this way, the inner casing 2 and outer casing 5 together form a container of the packaging assembly 1 for the articles or e-cigarettes C.

With reference to FIGS. 1 to 5 of the drawings, it can be seen that the inner casing 2 includes an end cap or bottom cap 6 designed to fit snugly over a lower end region of the inner casing 2 in a snap-fit via fastening clips 30, each of which respectively comprises a groove 32 (i.e. on front and rear outer sides of the inner casing 2) and a complementary tongue element 31 on opposite inner sides of the end cap 6. In this way, the end cap 6 is fixed to the inner casing 2 and forms a base for the packaging assembly 1 as a whole. At the upper end region, on the other hand, the packaging assembly 1 includes a cover member 7 in the form of an oval-shaped lid which is pivotally connected via a hinge connection 8 to the outer casing 5. This cover member or lid 7 is pivotable via this hinge connection 8 between a closed position as shown in Referring back to FIG. 1 and FIG. 2 of the drawings briefly, it will be noted that differences between FIG. 1 and FIG. 2 do not just concern the position of the oval-shaped lid 7. Rather, it will be seen that the outer casing 5 is displaced vertically downwards relative to the inner casing 2 towards the end cap 6 over a displacement distance d such that arrow-head symbols provided on both the inner and outer casings 2, 5 are moved towards one another. The position of the outer casing 5 shown in FIGS. 1(*a*) to 1(*e*) corresponds to a first, non-activated position A of the packaging assembly 1, whereas the position of the outer casing 5 shown in FIGS. 2(*a*) to 2(*e*) corresponds to a second, activated position B.

The specific structure of the packaging assembly 1 and the manner in which its various component parts interconnect and interrelate will now be explained with particular reference to the two exploded views in FIGS. 4 and 5 of the drawings, as well as to the FIGS. 6(*a*) to 6(*k*) and FIGS. 7(*a*) to 7(*k*), which not only show a number of cross-sectional views of the packaging assembly 1, but also illustrate details of specific features of the packaging assembly 1 in different states of operation.

As is apparent from FIGS. 4 and 5 of the drawings, the hinge connection 8 of the packaging assembly 1 includes a hinge element 9 on the cover member or lid 7 which is received between and cooperates with complementary hinge elements 10 on a rear side of the outer casing 5. A corresponding pin 11 is inserted through the respective hinge elements 9, 10 to define an outer pivot axis O for this hinge connection 8. In addition, the inner casing 2 can be seen to have upstanding rod-like connecting elements 12, each of which includes at an upper end thereof a transverse slot 13 for receiving one respective end of a corresponding stud pin 14. An opposite end of each stud pin 14 is inserted in a corresponding bore of additional hinge elements 15 provided on an inner side of the cover member or lid 7. In this way, therefore, the lid 7 is pivotally connected not only to the outer casing 5 via the hinge connection 8 about the outer pivot axis O, but also to the inner casing 2 at an upper end the connecting elements 12 via a second hinge connection 16 about an inner pivot axis X. This double hinge connection is perhaps most clearly apparent from the cross-sectional views shown in FIGS. 7(*b*) and 7(*h*).

By virtue of the hinge connections 8, 16 to both the outer casing 5 and the inner casing 2, the downward movement of the outer casing 5 relative to the inner casing 2 from the first position A (as shown in FIG. 1) to the second position B (as shown in FIG. 2) forces the lid 7 out of its closed position where it seals against a rim 17 at an upper end of the outer casing 5. This opening of the cover member 7 occurs because the outer casing 5 moves down with respect to the upstanding rod-like connecting elements 12 of the inner casing 2, which in turn act upwardly upon the cover member 7. As this occurs, the stud pins 14 permit pivoting about the inner pivot axis X and are also able to displace laterally within the horizontal slot-like recesses 13 in the connecting elements 12 thereby to permit the lid 7 to rotate to the open position about the outer pivot axis O in its hinge connection 8 with the outer casing 5. Although the hinge connection 8 in this embodiment is formed projecting from a rear side of the outer casing 5, it will be noted that it could alternatively be set into the outer casing 5 in order to provide the packaging assembly 1 with a smooth or flush rear surface.

Referring again to FIGS. 4 and 5, the packaging assembly 1 includes a coil spring 18 which is mounted between the inner casing 2 and the outer casing 5 around a central one of the tubular receptacles 3 that define the inner compartments 4. This coil spring 18 is configured to bias the outer casing 5 into the first position A, as shown in FIG. 6. Accordingly, when the outer casing 5 is grasped and moved downwardly by a user in the vertical direction relative to the inner casing 2 towards the second position B, that movement occurs against the urging force of the coil spring 18, which is gradually compressed by that movement (cf. FIG. 6(*d*) and FIG. 7(*d*)).

The packaging assembly 1 also includes stop elements 19, 20 in the form of projections or abutments which interengage to define limits to the movement of the outer casing 5 relative to the inner casing 2, and thus effectively define the first and second positions A, B. With reference to FIG. 6(*b*), for example, and especially to the upper detail in that drawing, it will be seen that the outer casing 5 includes an inwardly directed projection or shoulder 19 which extends into a slot or recess 21 in a rear side of the inner casing 2 and engages a shoulder or complementary abutment member 20 at an upper end of that recess 21 to limit upward movement of the outer casing 5 relative to the inner casing 2 against the bias of the coil spring 18. With reference also to FIG. 7(*b*) and the corresponding upper of the two details in that drawing, the inwardly projecting abutment element 19 on an inner side of the outer casing likewise cooperates with a shoulder or lower end 20' of the recess 21 formed in the rear side of the inner casing 2 to form a lower stop or limit to the downward displacement of the outer casing 5 in the second position B.

With reference now to FIGS. 6(*h*) and 7(*h*), and particularly to the corresponding detail in each of those drawings, it is seen that the inner and outer casings 2, 5 have complementary latching elements 22, 23 which are configured and arranged to engage and releasably interlock with one another when the outer casing 5 is displaced downwardly relative to the inner casing 2 to the second position B. That is, by interlocking, the complementary latching elements 22, 23 are designed to hold the outer casing 5 in the second position B relative to the inner casing 2 and thereby hold the lid 7 in the open position, despite the compressed spring 18 acting to bias or urge the outer casing 5 back towards the first position A. In this regard, the complementary latching elements 22, 23 in this embodiment comprise a pair of prong elements 22 at a front side of the inner casing 2, as is particularly apparent from FIG. 4, and complementary sawtooth-like projections 23 adjacent the prong elements 22 on an inner side of the outer casing 5. As seen in FIGS. 6(*h*) and 7(*h*), each of the prong elements 22 presents a tapered or an inclined face 24 and a locking face 25, and each of the sawtooth-like projections 23 similarly presents a tapered or an inclined face 26 and a locking face 27. The locking faces 25, 27 engage and interlock with each other when the outer casing 5 is in the second position B. By applying a predetermined force to the end of the inner casing 2 (e.g. at end cap 6) relative to the outer casing 5, however, the complementary latching elements 22, 23 are designed to automatically disengage or release from each other. To this end, the prong elements 22 may flex or deflect to facilitate both the interlocking and the release.

When the outer body part or outer casing 5 of the packaging assembly 1 has been moved to the second position B and the cover member or lid 7 is in the open position shown in FIG. 2 and FIG. 7, the mechanism comprising the interconnections of the inner and outer casings 2, 5 with the cover member or lid and the spring element 18 is configured to automatically move the lid 7 back to the closed position upon (re-)insertion or (re-)introduction of one of the e-cigarettes or articles C into a respective one of the inner compartments 4. That is, when inserted into the inner compartment 4, an end of the e-cigarette C contacts and presses against an inner side of the cap 6 forming a base of the inner casing 2. In this way, the user may impart a small force or impulse to the inner casing 2 via the e-cigarette C relative to the outer casing 5, which then acts to disengage or release the complementary latching elements 22, 23, such that the inner and outer casings 2, 5 move relative to one another under the action or bias of the coil spring 18 to the first position A and the cover member or lid 7 moves from the open position back to the closed position. Even the weight of the e-cigarettes C acting on the inner casing 2 relative to the outer casing 5 held by the user may be sufficient to release or disengage the latching elements 22, 23.

Finally, it will be noted that the outer casing 5 includes grip elements 28 having a raised profile on opposite sides of the packaging assembly 1 to enhance a user's grip on the outer casing 5 to promote a comfortable and secure handling of the outer casing 5 by a user. Thus, the grip elements 28 enable easier manual movement of the outer casing 5 relative to the inner casing 2 between the first and second positions A, B. The grip elements 28 may be injection molded with the outer casing 5 or may be made strips of a resilient synthetic rubber inserted or extending from recesses formed in the sides of the outer casing 5.

Although specific embodiments of the invention have been illustrated and described herein, it will be appreciated by those of ordinary skill in the art that a variety of alternate and/or equivalent implementations exist. It should be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

Also, it will be appreciated that in this document, the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

LIST OF REFERENCE SIGNS

1 packaging assembly
2 inner body part or inner casing
3 tubular receptacle
4 inner compartment
5 outer body part or outer casing
6 end cap
7 cover member or lid
8 hinge connection
9 hinge element
10 hinge element
11 pin
12 connecting element
13 transverse slot or recess
14 stud pin
15 hinge element
16 hinge connection
17 upper rim of outer casing
18 spring element
19 stop element or projection
20 stop element or shoulder
21 slot or recess
22 latching element or prong element
23 latching element or sawtooth-like projection
24 tapered or inclined face
25 locking face
26 tapered or inclined face
27 locking face
28 grip element
30 fastening clip
31 tongue element
32 groove
C article or e-cigarette
A first position
B second position
d displacement distance
O outer pivot axis
X inner pivot axis

The invention claimed is:

1. A packaging assembly for packaging one or more articles, comprising:

an inner body part defining at least one inner compartment to receive an article;

an outer body part at least partially enclosing or encompassing the inner body part; and a cover member that is movable between a closed position preventing access to the at least one inner compartment and an open position permitting access to the at least one inner compartment;

wherein the outer body part is movable relative to the inner body part between a first position and a second position to move the cover member between the closed position and the open position, wherein the inner and outer body parts include complementary latching means configured and arranged to engage and releasably latch or interlock with each other when the outer body part is in the second position relative to the inner body part, to hold the cover member in the open position, and wherein the cover member is pivotally connected to the outer body part via a hinge connection for pivoting movement between the closed position and the open position when the outer body part moves relative to the inner body part between the first position and second position, respectively.

2. A packaging assembly according to claim 1, wherein the outer body part is movable in a translational or sliding displacement relative to the inner body part between the first position and second position.

3. A packaging assembly according to claim 1, wherein the cover member is pivotally connected to the inner body part via a hinge connection so that the cover member pivots between the open and closed positions relative to the inner body part.

4. A packaging assembly according to claim 1, wherein the inner body part forms an inner casing and the outer body part forms an outer casing that surrounds the inner casing, especially in the form of a sleeve.

5. A packaging assembly according to claim 1, wherein the complementary latching means include at least one first latching element on an inner surface of the outer body part and at least one complementary second latching element respectively provided on an outer surface of the inner body part, wherein one or both of the first and second latching elements is deformable or deflectable to facilitate interlocking and/or release of the complementary latching means.

6. A packaging assembly according to claim 5, wherein the first latching element includes a first locking face which cooperates and abuts with a second locking face of the second latching element when the outer body part is in the second position relative to the inner body part, in order to hold the cover member in the open position.

7. A packaging assembly according to claim 5, wherein the complementary latching means are configured to disengage automatically from each other upon pressure or traction force exerted at an end of the inner body part relative to the outer body part.

8. A packaging assembly according to claim 1, wherein the inner body part and the outer body part include stop means which define the first and second positions and limit movement of the outer body part relative to the inner body part between the first and second positions.

9. A packaging assembly according to claim 1, wherein the inner body part is configured to accommodate elongate articles in the at least one inner compartment and is mounted in the outer body part such that a proffering of said articles is achieved through an opening in the outer body part when the outer body part is in the second position.

10. A packaging assembly according to claim 1, wherein the cover member is configured to form an airtight closure or seal of at least one opening in the outer body part and/or of the at least one inner compartment of the inner body part in the closed position.

11. A packaging assembly according to claim 1, wherein the inner body part, the outer body part and the cover member are made from a plastic material.

12. A packaging assembly according to claim 11, wherein the plastic material comprises polyethylene, polypropylene, or polyurethane.

13. A packaging assembly according to claim 12, wherein the wherein the inner body part, the outer body part and the cover member are made by injection molding.

14. A pack of articles comprising a packaging assembly according to claim 1, wherein a plurality of articles are held within the at least one inner compartment of the inner body part.

15. A packaging assembly for packaging one or more articles, comprising:

an inner body part defining at least one inner compartment to receive an article;

an outer body part at least partially enclosing or encompassing the inner body part; and a cover member that is movable between a closed position preventing access to the at least one inner compartment and an open position permitting access to the at least one inner compartment;

wherein the outer body part is movable relative to the inner body part between a first position and a second position to move the cover member between the closed position and the open position, and wherein the inner and outer body parts include complementary latching means configured and arranged to engage and releasably latch or interlock with each other when the outer body part is in the second position relative to the inner body part, to hold the cover member in the open position, further comprising biasing means, especially at least one spring member, which biases or urges the outer body part towards the first position relative to the inner body part.

16. A packaging assembly for packaging one or more articles, comprising:

an inner body part defining at least one inner compartment to receive an article;

an outer body part at least partially enclosing or encompassing the inner body part; and a cover member that is movable between a closed position preventing access to the at least one inner compartment and an open position permitting access to the at least one inner compartment;

wherein the outer body part is movable relative to the inner body part between a first position and a second position to move the cover member between the closed position and the open position, wherein the inner and outer body parts include complementary latching means configured and arranged to engage and releasably latch or interlock with each other when the outer body part is in the second position relative to the inner body part, to hold the cover member in the open position, and wherein the cover member is pivotally connected to the outer body part via an outer hinge connection and is pivotally connected to the inner body part via an inner hinge connection, such that when the outer body part is translated relative to the inner body part between the first position and the second position, the cover member is pivoted relative to both the outer body part and the inner body part between the closed position and the open position, respectively.

* * * * *